US011992069B2

(12) United States Patent
Barajas

(10) Patent No.: US 11,992,069 B2
(45) Date of Patent: May 28, 2024

(54) GRIPPING APPARATUS

(71) Applicant: Bryan Barajas, Hacienda Heights, CA (US)

(72) Inventor: Bryan Barajas, Hacienda Heights, CA (US)

( * ) Notice: Subject to any disclaimer, the term of this patent is extended or adjusted under 35 U.S.C. 154(b) by 0 days.

(21) Appl. No.: 17/847,675

(22) Filed: Jun. 23, 2022

(65) Prior Publication Data

US 2023/0413928 A1 Dec. 28, 2023

(51) Int. Cl.
*A41D 13/08* (2006.01)
*A63B 71/14* (2006.01)

(52) U.S. Cl.
CPC ..... *A41D 13/082* (2013.01); *A63B 71/14* (2013.01)

(58) Field of Classification Search
CPC ..... A41D 13/082; A41D 19/01547; A63B 71/146; A63B 21/0726
See application file for complete search history.

(56) References Cited

U.S. PATENT DOCUMENTS 1,229,658 A * 6/1917 Sandow ..... A63B 21/0726 482/50
2,077,202 A * 4/1937 Barrie ..... A01J 1/00 473/59
2,710,970 A * 6/1955 Kennedy ..... A41D 19/01547 2/18
2,994,530 A * 8/1961 Cohan ..... A63D 5/00 482/49
3,129,939 A * 4/1964 Stock ..... A63B 23/16 482/49
3,398,951 A * 8/1968 Disko ..... A63B 71/148 2/21
3,496,573 A * 2/1970 Pope ..... A63B 71/148 473/59
3,545,784 A * 12/1970 Allsop ..... A63C 11/2224 280/821
3,606,614 A * 9/1971 Dimitroff ..... A63B 71/148 473/59
3,640,532 A * 2/1972 Bauer ..... A63B 69/0071 601/40
4,082,303 A * 4/1978 Finnegan ..... A63C 11/2228 280/822
4,234,202 A * 11/1980 Loffelholz ..... A63C 11/2228 280/820

(Continued)

*Primary Examiner* — Jillian K Pierorazio
(74) *Attorney, Agent, or Firm* — Omni Legal Group; Omid E. Khalifeh; Ariana Santoro

(57) ABSTRACT

A gripping apparatus is provided to reduce friction and skin impingements on a user's hand and prevent friction and skin impingement related injuries. The gripping apparatus comprises a strap and a cushion configured to define a wearable band that provides a barrier between a user's skin and an object being gripped. A ridge is disposed on an inside of the cushion to provide a barrier between folds of skin on the user's palm, thus further reducing the friction and impingements caused by the skin rubbing against itself. At least one groove defines an edge of the cushion, which is configured to prevent the edge of the cushion from digging into a user's hand when gripping an object. The band comprises elastic material, which allows the band to be worn in multiple configurations and flex to fit the unique shape of each individual user.

14 Claims, 7 Drawing Sheets

(56) References Cited

U.S. PATENT DOCUMENTS 4,329,741 A * 5/1982 Bach ..... A63B 71/146 2/161.2
4,351,526 A * 9/1982 Schwartz ..... A63B 21/4019 482/108
4,558,694 A * 12/1985 Barber ..... A61F 5/10 602/21
4,617,684 A * 10/1986 Green ..... A41D 13/082 2/19
4,711,445 A * 12/1987 Whitehead ..... A63B 23/16 482/49
4,754,499 A * 7/1988 Pirie ..... A41D 13/082 294/25
5,005,824 A * 4/1991 Eichel ..... A63B 23/16 482/44
5,076,569 A * 12/1991 Gootter ..... A63B 23/16 482/49
D363,146 S * 10/1995 Pando ..... D29/113
5,479,660 A * 1/1996 Najac ..... A41D 13/082 2/161.1
5,634,214 A * 6/1997 St. Ville ..... A63B 71/146 2/161.1
5,638,767 A * 6/1997 Bush ..... A41D 19/01594 116/DIG. 44
D387,826 S * 12/1997 Smallwood ..... 482/49
5,803,821 A * 9/1998 Lupinacci ..... A63B 71/146 2/161.3
5,806,091 A * 9/1998 McHugh ..... A41D 13/082 473/212
5,823,922 A * 10/1998 Eckmann ..... A63B 21/4035 482/44
6,183,400 B1 * 2/2001 Pope ..... A63B 21/4019 74/551.8
6,732,374 B1 * 5/2004 Blair ..... A63B 21/4019 2/20
8,209,771 B1 * 7/2012 Sykes ..... A41D 13/082 2/21
8,613,675 B2 * 12/2013 Newman ..... A63B 69/3608 473/409
D710,955 S * 8/2014 Boruch ..... D21/662
D867,492 S * 11/2019 Didia ..... D21/694
D964,660 S * 9/2022 Sternke ..... D29/113
2006/0253955 A1 * 11/2006 Kratsa ..... A41D 13/082 2/159
2008/0070762 A1 * 3/2008 White ..... A63B 23/1281 482/108
2012/0096614 A1 * 4/2012 Sebasco ..... A41D 13/082 2/16
2015/0067946 A1 * 3/2015 Ditto ..... A63B 71/141 2/161.3
2018/0154243 A1 * 6/2018 Kiernan ..... A63B 71/143
2019/0223527 A1 * 7/2019 George ..... A41D 19/01547
2019/0231007 A1 * 8/2019 Tamaribuchi .... A41D 19/01547
2020/0260806 A1 * 8/2020 Paulson ..... A63B 60/22

* cited by examiner

GRIPPING APPARATUS

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to workout accessories for use with weightlifting. More specifically, the present invention relates to a band comprising that provides a barrier between the user's skin and the workout equipment being gripped.

BACKGROUND

Weightlifters, both professional and novice, experience injuries on their hands caused by friction between the soft skin of the palm and the workout equipment or other skin. Although the human body will develop calluses on the palm to ease these types of injuries, the calluses take time to form, allowing injury during that time. Further, many find these calluses to be undesirable as they affect the appearance and texture of the hand and may even cause reduced sensation, which, in particular, is undesirable for professionals who may rely on manual dexterity and sensitivity to do their jobs, such as doctors and musicians.

One proposal to protect the hands while weightlifting is to use chalk as described in U.S. Pat. No. 5,565,023 to Sereboff. However, this proposal is deficient as chalk is messy to apply and known to leave residue behind on equipment or clothing. Further, the use of chalk comes with some health risks from breathing in airborne chalk, drying out the skin, and particles entering into cuts, tears, and open wounds in the skin. Additionally, chalk may need to be applied multiple times throughout a workout, and failing to do so may lead to chalk being ineffective at preventing calluses and skin tears.

Gloves have also been proposed to protect the hands while weightlifting as in U.S. Pat. No. 9,844,693 to Jones and 9,421,449 to Ditto. These proposals are deficient, in one respect, as the gloves trap heat, causing users to sweat. Accumulation of sweat in the gloves makes them moist and can exacerbate skin issues, such as eczema. Additionally, the gloves can develop an odor from the sweat and become a breeding ground for bacteria, which can cause further infections to the skin and any open wounds. Further, many weightlifters find that wearing gloves impacts their grip on the weights. In particular, glove users often have trouble feeling equipment through their gloves and fail to optimally adjust their grip. As such, they may not engage all desired muscle groups and can be at risk for injury due to poor form caused by poor grip. It is recommended that users wear gloves with a tight fit—like a second skin—to reduce the impact on grip, however, this makes the gloves difficult to remove and replace during a workout. While some users may elect to leave their gloves on throughout their workout, this can impact fine motor skills necessary for, for example, opening a water bottle, adjusting the fitness equipment being used, turning a door knob, or, in some cases, using a touchscreen to check one's phone. The configuration of the glove fingers, in particular, further limits users from providing additional support to their fingers by a splinting or buddy taping, as they generally separate the fingers from one another.

One proposal to improve traditional weightlifting gloves is U.S. Pat. No. 9,931,533 to Ingram for lifting straps. Such lifting straps provide a tool to improve one's grip on workout equipment without the need for gloves. However, this proposal remains deficient because the straps are not ergonomically designed to prevent the impingement of the user's palm skin when gripping equipment. Instead, they act as a mere cover for the palm. This proposal is further deficient because it fails to correct a user's grip to engage and stimulate a wider range of muscle groups. Instead, it is merely an assist to prevent one's loss of grip. Further, this proposal is deficient because of its time to set up. Users not only have to connect the straps to their hands and wrists, but they also have to engage the straps with each individual piece of equipment they plan to use. Indeed, excess lengths of unsecured strap can easily become caught by the user's limbs or in the equipment, which can lead to injury. As such, the straps must be wrapped repeatedly around the equipment until the strap does not obstruct the user, and, repeatedly unwrapped to disengage them. Thus, it may be seen that lifting straps requires additional time to set up prior to each set of repetitions, which can be significant over the course of a workout. Additionally, as is the case with workout gloves, lifting straps are difficult to clean. They are commonly made of woven or braided nylon or cotton material, which cannot simply be wiped down, leading to the proliferation of bacteria and, consequently, development of an odor.

Thus, although various proposals have been made to reduce the injury to the palm caused by weightlifting, none of those in existence combine the characteristics of the present invention. Therefore, there remains a need for a hygienic device which can protect the skin on the palm of the hand without requiring extensive time and setup, while allowing the user to retain the benefits of tactile feedback from the hand and enhancing the grip to engage additional muscles.

SUMMARY

The present disclosure is directed to a gripping apparatus comprising a strap and a cushion configured to provide a barrier between the palm of a user's hand and an object being gripped as well as between portions of a palmar side of the user's hand in order to reduce friction on the skin. The gripping apparatus may be a band made of an elastic material configured to conform to the user's hand and preserve a user's ability to receive tactile feedback while covering portions of the palm to prevent injury.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

The strap may comprise a first end, a second end, an inner surface, and an outer surface. The cushion may be defined by a front edge and a rear edge spaced apart from one another by a first side edge and a second side edge. Further, the cushion may have an inside and an outside. The inner surfaces of the strap and cushion are defined as the portion of the band that, when worn, contacts the user. The outer surface of the strap and the outer of the cushion are defined as the portion of the band that does not directly contact the user's skin when in use. For example, the outside of the cushion may be configured to contact an object being gripped when in use.

The first end of the strap may connect to the first side edge of the cushion, and the second end of the strap may connect to the second side edge of the cushion. As described, the strap and the cushion may be connected to one another in order to define the band. In some embodiments, one or both of the ends of the strap may be removably securable to the first and second side edges, respectively, to define the band.

In one embodiment, the cushion may be configured to provide a barrier between a user's skin and a gripped object when in use and thus, may prevent friction-related injuries such as blisters, rashes, chafing, torn skin, and other irritation. Additionally, by creating a barrier with the skin, the cushion may prevent the loss of sensation and altered appearance of the hand caused by calluses. The cushion may be further configured to provide a barrier to the skin of a user's interdigital folds itself, reducing friction and skin impingement, and thus friction and impingement-related injuries, between the folds and creases of the user's skin.

The cushion may have a width defined by the length of the front and rear edge and a height defined by at least the length of the first and second side edges. In some embodiments, the front edge and the rear edge may comprise the same length. However, in another embodiment, the front edge and the rear edge may comprise different lengths, as such the cushion may have a different width at the front and rear edges.

In instances where the front and rear edges comprise different lengths, the height of the cushion may be defined by the length of the first and second side edges with consideration to the angle at which the first and second side edges extend from the front and rear edges. In some embodiments, the first and second side edges may have different lengths, as such, it will be recognized that the cushion need not have a uniform length to practice the invention. In a further embodiment, the cushion may have a height greater than the first and second side edges at any point along the width of the cushion. It is contemplated that in instances where the height is not uniform, any of the edges of the cushion may be rounded in order to prevent abrupt changes to the shape or avoid defining a portion of the gripping apparatus by sharp angles that might uncomfortably dig into the wearer's hand. In such an embodiment, the height of the cushion may be sized such that it comprises less than all the height of a user's palm. In another embodiment, the height of the cushion may be sized such that it comprises less than all the distance between the user's Kaplan's cardinal line and a ridge on the palm proximal to the user's fingers. Further, the ridge may be disposed on the inside of the cushion, such that the height of the cushion corresponds to a ridge on the palm proximal to the user's fingers and a distal palmar crease.

The front edge of the cushion may be defined by one or more grooves configured to align with at least one of the fingers of the user. In some embodiments, the cushion may comprise up to four grooves, each groove operative to align with a corresponding one of the user's fingers. For the sake of clarity, it is contemplated that the up to four grooves may be configured to align with any or each of the user's index, middle, ring, and little fingers.

In an embodiment in which the cushion comprises a plurality of grooves, any of the grooves may be offset from another groove or grooves. It is contemplated that the grooves may be offset in order to approximate the natural curvature of a top edge of a palm.

In some embodiments, any of the at least one groove may be defined by at least one peak separating a groove from another groove. It is contemplated that the peak may, in some instances, be configured to separate the user's fingers from one another when in use. In some such embodiments, the at least one groove may be configured such that it provides separation only at the proximal end of the user's fingers, thus allowing a user to adjust their fingers as needed without constraint, allowing a more natural grip and increased tactile feedback. It is further contemplated that by providing separation only at the proximal end of the user's fingers, a user may provide additional support to the fingers, for example by a splint or buddy taping, while wearing the band.

The cushion may comprise a ridge disposed along the inside of the cushion configured to separate portions of the user's skin that might otherwise rub against or impinge on one another. In some embodiments, the ridge may span from the first side edge of the cushion to a second side edge of the cushion. In another embodiment, the ridge may span across less than all the distance between the first side edge and the second side edge of the cushion.

In some embodiments, the ridge may be operative to engage a ridge of skin on a user's palm proximal to the fingers. For example, the ridge of skin on the user's palm proximal to the fingers may be a crease on the user's hand distal to the head of each metacarpal, which a person of ordinary skill in the art will recognize as the palmar digital crease.

It is contemplated that the ridge may be flexible and operative to compress and fit a range of hand sizes. In some embodiments, the ridge may be made out of the same material as the band.

The strap may comprise a solid material, which may beneficially reduce deformation during use and aid longevity of the band. In some embodiments, however, the strap may define one or more apertures. It is contemplated that providing apertures may beneficially increase airflow to the hand when the band is in use.

The band may be worn along any portion of the user's hand and wrist. In some instances, the band may be worn so that the strap rests across the dorsal side of the user's hand and the cushion rests on the palm such that the at least one groove aligns with the proximal phalanges comprising any or all of the user's fingers. Wearing the band as described may provide the barrier to the palm in instances where the user is performing a pulling motion, such as when performing pull-ups on a bar, seated cable rows, or bicep curls while gripping barbells, dumbbells, kettlebells or the like. In some instances, such as when a user is performing a pushing motion against a bar or rigid surface, the band may be worn so that the ridge on the inside of the cushion is aligned between the user's distal palmar crease and proximal palmar crease. In some, more generally, the band may be worn so that the rear edge of the cushion is proximal to a top edge of the user's palm. It is contemplated that in the aforementioned instances, the cushion may increase the girth of the user's grip by increasing the circumference of the object being gripped due to the thickness of the cushion resting between the user's palm and the gripped surface. This increase in circumference and overall girth of the user's grip around a surface, such as workout equipment, may activate more muscles and lead to improved results over those produced under a conventional, relatively narrower grip. Further, the band may be worn around the user's wrist when not in use, allowing the user to keep the band on their person when not in use, reducing the likelihood of losing the band. In addition, by allowing the band to be worn around the user's wrist, the user may quickly access it when alternating between workout sets.

In some embodiments, the cushion and the strap may have the same thickness. It is further contemplated that in some embodiments, the cushion and the strap may have different thicknesses. For example, the cushion may have a greater thickness than the strap, such that the cushion may increase the girth and even the width of the user's grip to activate more muscles in addition to providing a barrier between a user's hand and the object being gripped.

In one embodiment, the band may comprise an elastic material such that it flexes with the user's hand during use and maintains its shape when not in use. Suitable elastic materials may, for example and without limitation, comprise natural or synthetic rubber, nylon, foam, thermoplastic polyurethane, polypropylene, and/or combinations thereof. A person of ordinary skill in the art will appreciate that the provided elastic materials are for example only and other elastic materials may be used. The band may further comprise a material suitable to withstand the friction caused by use, such as rubber, while retaining its shape. One of ordinary skill in the art will also recognize that, in some embodiments, it may be desirable for the band to comprise non-woven materials that will be easily cleaned such as by rinsing or wiping. For example, it is well understood that bacterial accumulation is unhygienic and may result in odors, the non-woven material may increase hygiene and prevent undesired odors. Indeed, in some embodiments, materials comprising the strap and cushion may be molded or even extruded as desired.

As individual human hands vary in size, it is contemplated that the band may be configured to accommodate a variety of hand sizes. In one embodiment, the band may comprise elastic material allowing the band to be stretched such that it may engage a plurality of different widths. In another embodiment, the band may comprise two lengths and a means for adjustably joining such lengths to one another. For instance, the band may comprise hook and loop fasteners, hook and eye fasteners, snaps, a clasp, or the like, allowing a user to manually adjust the band as desired or needed.

Several advantages of one or more aspects of the present invention are that it:

a.) provides an easy-to-use weightlifting accessory;

b.) protects a discrete portion of the hand when in use and otherwise maintains airflow to the hand;

c.) is capable of being worn around a user's wrist without interference when not in active use;

d.) utilizes materials that can be easily cleaned without the need for special equipment, such as a washing machine;

e.) activates a wider range of muscles during use by widening the user's grip;

f.) prevents calluses and torn skin by reducing the friction caused by the object being gripped and the impingement of the folds of skin on the hand;

g.) creates a barrier between the sweat produced on a user's palm and the gripped object such that the sweat does not cause the gripped object to slip; and h.) reduces pressure and strain on a user's hand joints during gripping exercises It is an object of this invention to reduce friction on the palm during use. It is another object of this invention to reduce strain on the user's hand joints during use.

It is a further object of this invention to reduce friction-related injuries, such as blisters, rashes, chafing, calluses or torn skin.

It is still a further object of this invention to reduce skin impingements as well as impingement-related injuries such as bruises or blisters.

It is yet another object of the invention to increase engagement of muscles by widening the user's grip.

It is another object of this invention to retain tactile feedback in a user's hand.

It is a further object of the invention to provide a gripping accessory that may be easily cleaned. It is yet another object of the invention to provide a gripping accessory that may be worn in multiple configurations.

One or more of the above-disclosed embodiments, in addition to certain alternatives, are provided in further detail below with reference to the attached figures. The disclosed subject matter is not, however, limited to any particular embodiment disclosed.

Figure 1:
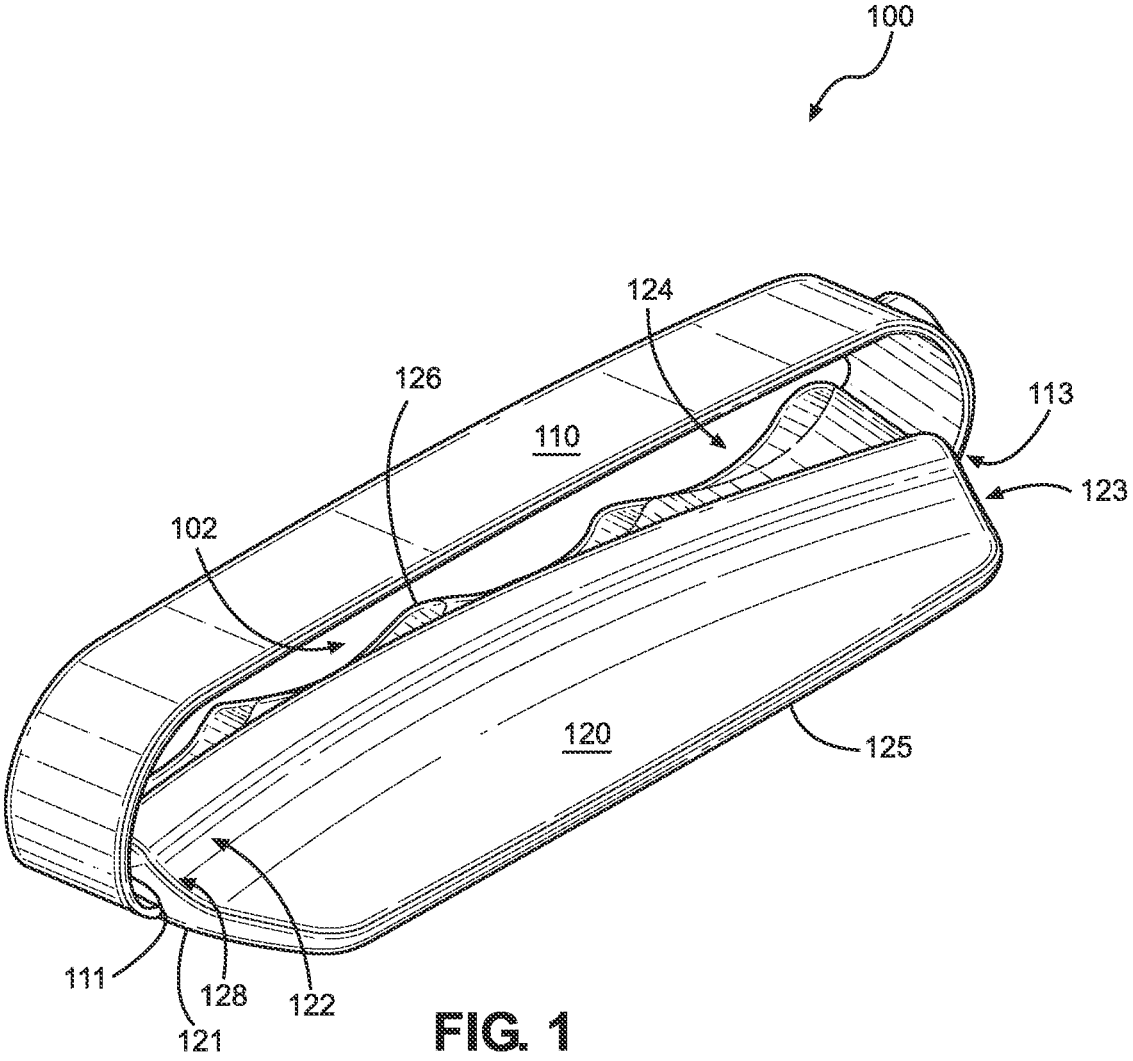
FIG. 1 shows a top rear perspective view of a gripping apparatus in accordance with one embodiment of the invention.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

The provided measurements are for the purpose of providing exemplary dimensions for the band. The provided ranges are inclusive of all numbers within the range and the bounds. The term "about" and the like should be broadly understood to refer to a suitable tolerance, such as, 10%.

A person of ordinary skill will further appreciate that human anatomy varies greatly between individuals. As such, all dimensions provided are for certain exemplary embodiments and are without limitation.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 2:
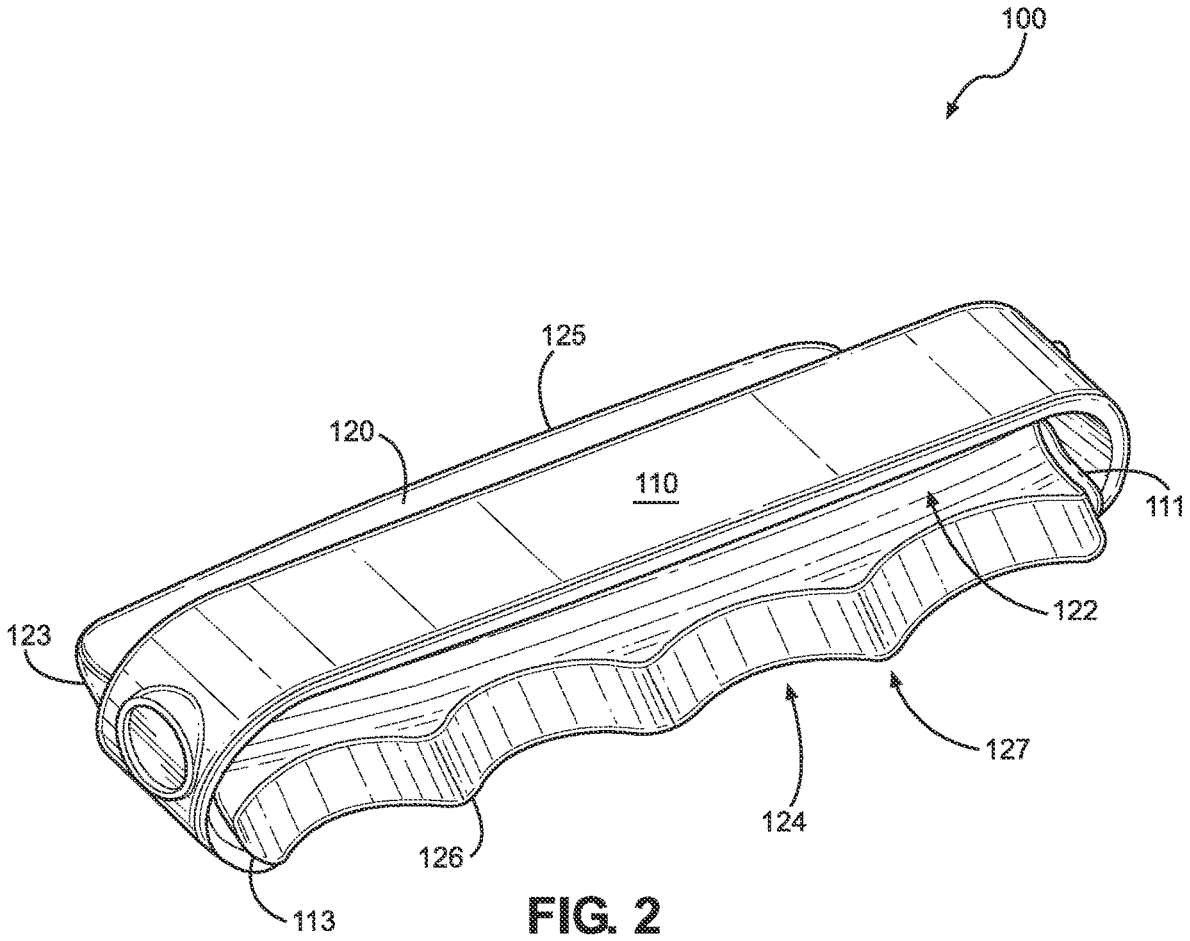
FIG. 2 shows a top front perspective view of a gripping apparatus in accordance with one embodiment of the invention.

With reference to FIGS. 1 and 2, a gripping apparatus may comprise a strap 110 and a cushion 120 connected to form a band 100. It is contemplated that the strap 110 and cushion 120 may be formed as discrete, joined elements or as in the non-limiting examples shown in the figures, as a single fully integrated piece.

Figure 3A:
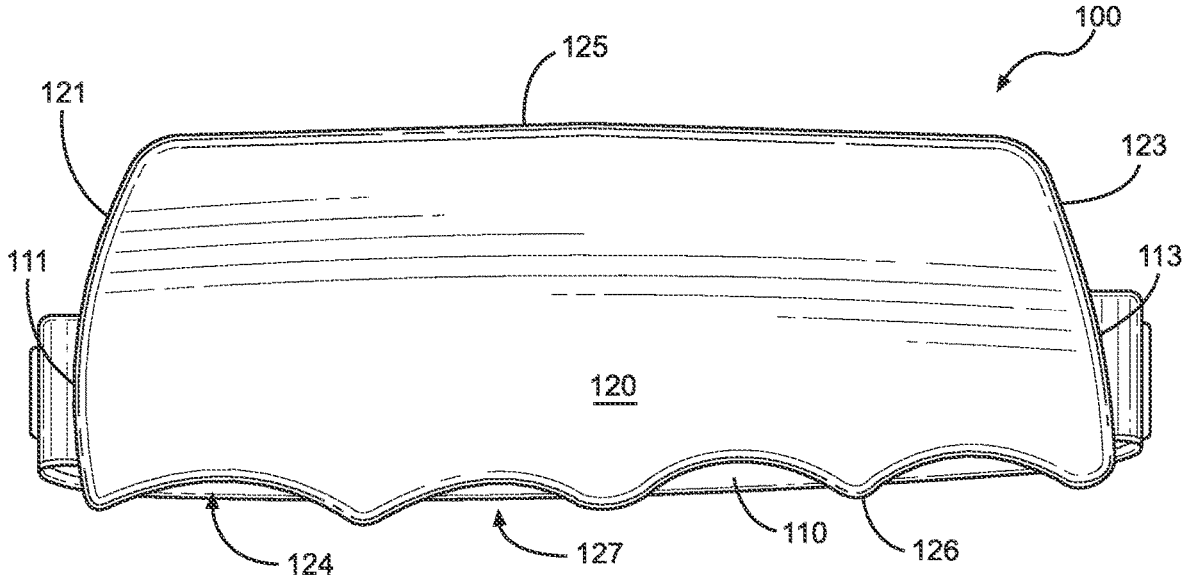
FIG. 3A shows a bottom view of a gripping apparatus in accordance with one embodiment of the invention.

The strap 110 may have a first end 111, a second end 113, an inner surface, and an outer surface. With reference to FIG. 3A, the first end 111 of the strap 110 may connect to a first side edge 121 of the cushion 120 and the second end 113 of the strap 110 may connect to a second side edge 123 of the cushion 120 to form the band 100. The cushion 120 may further comprise an inside and an outside. The inside and outside of the cushion 120 may be configured to align with the inner surface and outer surface of the strap 110, respectfully. As such, the band 100 may have an inner surface defined by the inner surface of the strap 110 and the inside of the cushion 120 and an outer surface defined by the outer surface of the strap 110 and the outside of the cushion 120.

Figure 5:
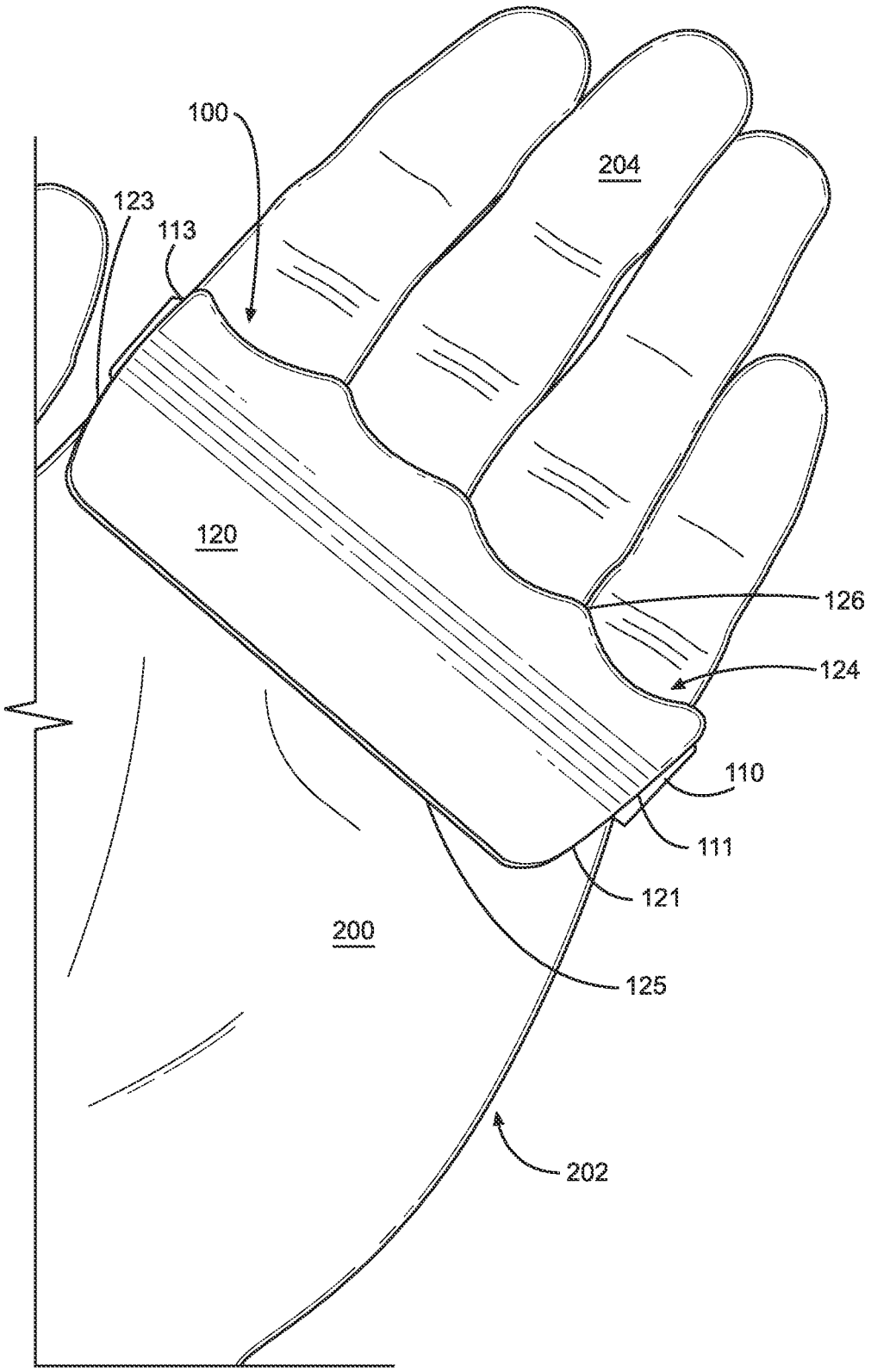
FIGS. 5 and 6 illustrate alternative bottom views of an embodiment of the invention in use.
Figure 6:
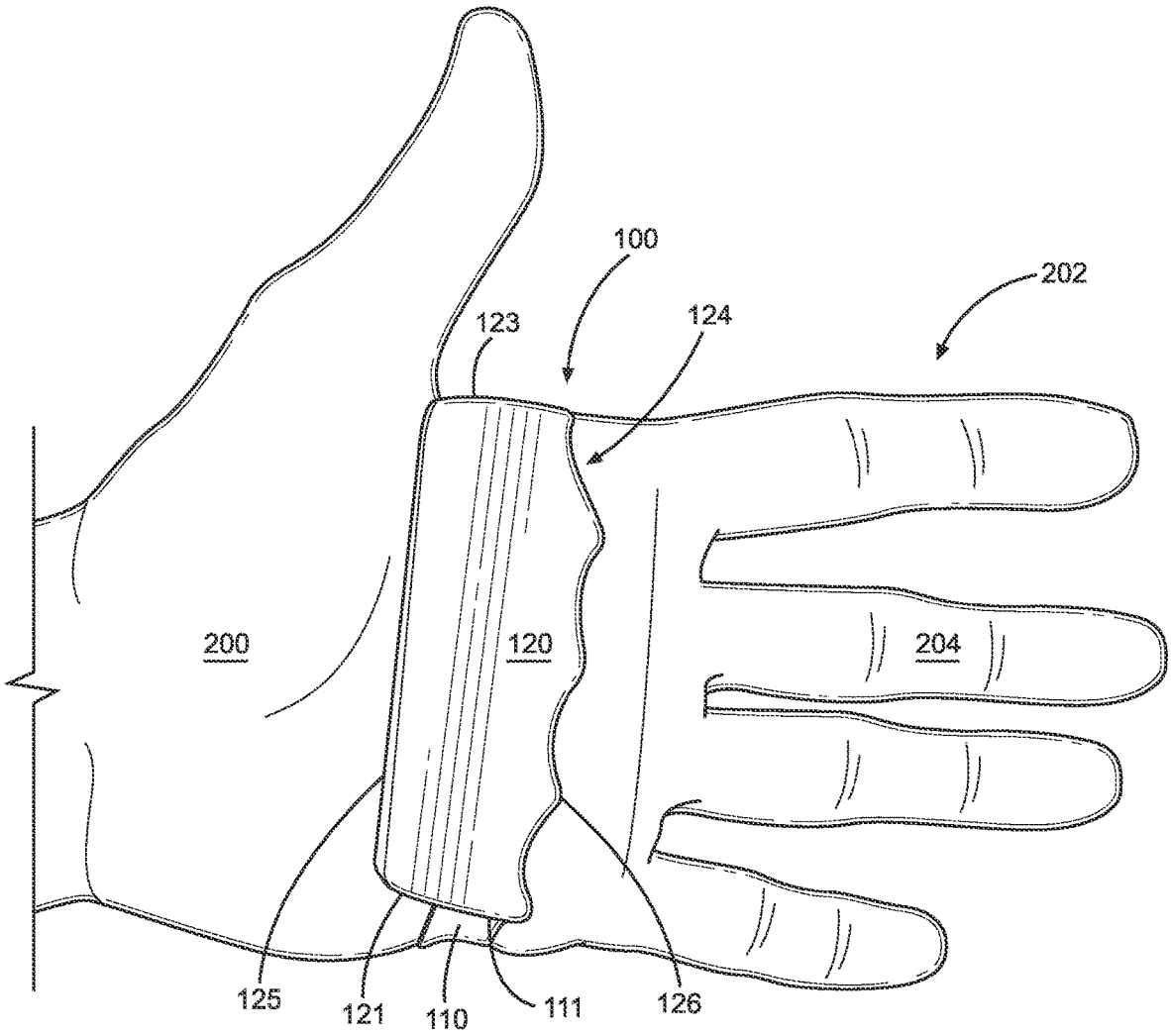
Figure 7:
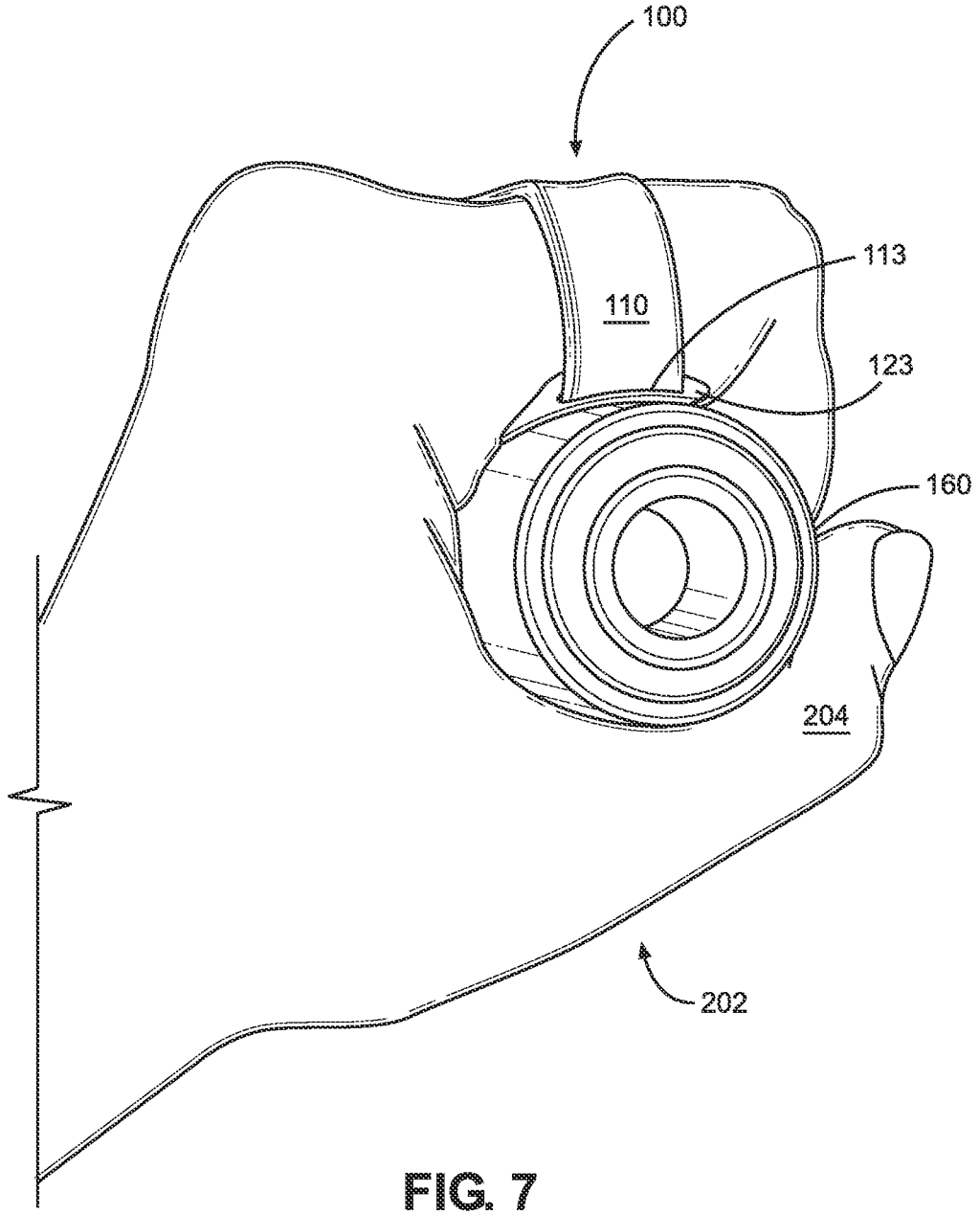
FIG. 7 illustrates a side view of an embodiment of the invention in use.

With particular reference to FIG. 1, the band 100 may comprise an opening 102, defined by the inner surface of the strap 110 and the inside of the cushion 120, operative to receive a user's hand 202, as illustrated in FIGS. 5-7 and discussed in further detail below.

Returning to FIG. 1, the distance between the inner surface of the strap 110 and the inside of the cushion 120 may be about 0.25 inches to about 1.0 inches. In one embodiment, such distance may be about 0.31 inches to about 0.53 inches. In another embodiment, such distance may be about 0.51 inches to about 0.84 inches.

As shown in FIGS. 5-7, the strap 110 may be configured to hold the cushion 120 against the user's hand 202. In some instances, the strap 110 may comprise an elastic material operative to engage the user's hand 202. For example, and without limitation, the elastic material may be silicone rubber, thermoplastic polyurethane, polypropylene, or combinations thereof, however, a person of ordinary skill in the art will appreciate other elastic materials that may be used with the invention. It is contemplated that the strap 110 and the cushion 120 may comprise the same or different materials.

The strap 110 may have a length defined by the distance between the first end 111 and the second end 113. In one embodiment, when worn as illustrated in FIG. 6, the strap 110 may be operative to connect to the first side edge 121 and the second side edge 123 of the cushion 120 and extend over a dorsal surface of the user's hand (obscured from view). For example, the strap 110 may be about 2.5 inches to about 5.5 inches long. In a further exemplary embodiment, the strap 110 may be about 2.75 inches to about 4.5 inches long. More particularly, the strap 110 may be about 2.97 inches to about 5.0 inches long. Although pictured as a single length, it is contemplated that the strap 110 may comprise a plurality of segmented lengths adjustably joined together in any manner known to those of ordinary skill in the art.

The strap 110 may be any width operative to secure the band 100 to the user's hand 202. For example only and not for limitation, the strap 110 may be about 0.25 inches to about 0.75 inches wide. In a further example, the strap 110 may be about 0.43 to about 0.60 inches wide. In yet another example, the strap 110 may be about 0.56 to about 0.65 inches wide.

It is contemplated that the strap 110 may comprise a solid material, as shown in the figures. However, it is also contemplated that the strap 110 may comprise one or more apertures on its surface (not shown). In some embodiments, the strap 110 may comprise embossing, such that the strap 110 may comprise a design, image, logo, pattern, trademark, or other word(s)/phrase(s).

The cushion 120 may be configured to provide a barrier between the skin of a user and an object 160, such as a bar, being gripped as shown in FIG. 7. In some instances, the cushion 120 may further provide a barrier between multiple folds of skin on a user's palm 200 and may prevent skin impingement. As shown in FIG. 7, the cushion 120 may provide a barrier between the skin distal and proximal to the palmar digital crease. It is contemplated that the cushion 120 may be of any size suitable to provide a barrier between the object 160 and the user's palm 200.

The width of the cushion 120 may be defined by a distance between the first side edge 121 and the second side edge 123. The distance between the first side edge 121 and the second side edge 123 may be equal to the length of the front edge 127 and the rear edge 125. The front edge 127 and the rear edge 125 may comprise different lengths, thus the cushion 120 may have a non-uniform width. With particular reference to FIG. 3A, the first side edge 121 and second side edge 123 may be rounded in order to create a continuous line in instances where the cushion 120 has a non-uniform width.

In an exemplary embodiment, as shown in FIGS. 5 and 6, the cushion 120 may have a width sufficiently sized to extend across the width of the user's palm 200. The width of the cushion 120 may be about 2 inches to about 5 inches, about 2.5 inches to about 3.5 inches, about 2.8 inches to about 4.0 inches, and about 3.5 inches to about 4.25 inches. It is contemplated that the exemplary widths may be used to create a variety of different sized bands 100 to accommodate a range of hand sizes.

With continued reference to FIG. 3A, the height of cushion 120 may be defined by the distance between the front edge 127 and the rear edge 125. In some embodiments, the distance between the front edge 127 and the rear edge 125 may be equal to the length of the first side edge 121 and the second side edge 123. In another embodiment, the distance between the front edge 127 and the rear edge 125 may be greater than the length of the first side edge 121 and the second side edge 123.

It is contemplated that the cushion 120 may have any height appropriate to provide a barrier to any portion of the user's palm 200. It is contemplated that the cushion 120 may provide a barrier to the entire length of the user's palm 200 or less than all the length of the user's palm 200. In an exemplary embodiment shown in FIG. 5, the height of the cushion 120 may comprise a distance from a point proximal to the proximal interphalangeal crease and a distal palmar crease on the user's hand 202. Of course, one of ordinary skill in the art will recognize such inherent portions of an average human hand. The height of the cushion 120 may be about 0.8 inches to about 1.7 inches, about 1.0 inches to about 1.25 inches, or about 1.3 inches to about 1.55 inches. It is contemplated that the exemplary heights may be used to create a variety of band sizes to accommodate a range of hand sizes.

In some embodiments, the cushion 120 may comprise a smooth, solid material, as shown in the figures. However, it is contemplated that the cushion 120 may be embossed, so that the cushion 120 may feature, display, or otherwise comprise a design, image, logo, pattern, trademark, or other word(s)/phrase(s). In one embodiment, the embossing may be disposed on the inside of the cushion 120. In another embodiment, the embossing may be disposed on the outside of the cushion 120. Further, the embossing may be disposed on the inside and the outside of the cushion 120. In some embodiments, the material may even be textured to further increase friction and improve grip security on a surface.

The cushion 120 may have any thickness operative to provide a barrier between the user's palm 200 and the object 160 being gripped. It is further contemplated that the thickness of the cushion 120 may widen the user's grip in order to stimulate a wider range of muscles when performing a workout. Exemplary thicknesses may include from about 0.01 inches to about 0.44 inches and from about 0.1 inches to about 0.3 inches. In some embodiments, the cushion 120 may have the same thickness throughout or may comprise a variety of thicknesses. For example, and without limitation, the thickness of the cushion 120 at the rear edge 125 may be thinner than the thickness at the first side edge 121. As a further clarifying example, the rear edge 125 and the front edge 127 of the cushion 120 may be thinner than a central portion of the cushion 120 to reduce resistance when bending the cushion 120 allowing the cushion 120 to form to the user's hand, preventing the rear edge 125 and front edge 127 from digging into the user's palm 200.

With particular reference to FIG. 1, the cushion 120 may further comprise a ridge 122 disposed along the inside of the cushion 120. In some instances, the ridge 122 may define a barrier operative to separate folded skin on the user's hand 202 in order to prevent skin impingement and reduce the friction caused by the skin rubbing against itself. In one embodiment, the ridge 122 may be configured to engage a ridge of skin on the user's palm 200 proximal to the user's fingers 204 when worn in the manner illustrated in FIG. 5, thus creating a barrier between the user's palm 200 and fingers 204. Returning to FIG. 1, the ridge 122 may be of any shape suitable to create a barrier. For example, and without limitation, the ridge 122 may be formed as a beam, fin, or dome.

In some embodiments, the ridge 122 may span the distance between the first side edge 121 and the second side edge 123, thus the ridge 122 may have a length equal to the width of the cushion 120. However, it is contemplated that the ridge 122 may, in some embodiments, span less than all the distance between the first side edge 121 and the second side edge 123.

It is contemplated that the ridge 122 may have any dimensions suitable to create separation between the skin on the user's hand 202. For example, the ridge 122 may have a height in the range of about 0.10 inches to about 0.40 inches. In another example, the ridge 122 may have a height in the range of about 0.15 inches to about 0.35 inches. As yet another example, the ridge 122 may have a height in the range of about 0.20 inches to about 0.31 inches.

In some embodiments, the configuration of the ridge 122 may be defined by the slope angle of each side of the ridge 122 relative to the same-side edge 125, 127 of the cushion 120. In some embodiments, for example, a side of the ridge 122 corresponding to the rear edge 125 of the cushion 120 may have a slope angle of about 20° to about 40° with respect to the cushion 120. The same may be said for the slope angle of a side of the ridge 122 corresponding to the front edge 127 of the cushion 120. In some embodiments, a side of the ridge 122 may have a slope angle of about 20°, 25°, 30°, 31°, 32°, 35°, and 40° with respect to the corresponding front or rear edge 125, 127 of the cushion 120. Those of ordinary skill in the art will recognize an entire range of sloping sufficient to practice the invention, and further, that each side of the ridge 122 may be sloped to a greater or lesser degree than the other side of the ridge 122 relative to the cushion 120.

In some embodiments, the ridge 122 may be flexible in order to allow the ridge 122 to conform to a surface in contact with the inside of the cushion 120. As shown in FIG. 6, the band 100 may be worn at a point on the user's palm 200 proximal to the palmar digital crease requiring the ridge 122 to compress against the surface of the user's palm 200 thus the height of the ridge 122 when in use may be less than the height of the ridge 122 when worn as shown in FIG. 5.

The width of the ridge 122 may be any size suitable for separation while allowing for the user to grip the object 160 as shown in FIG. 7. For example, the width may be defined by the height of the ridge 122 and a desired radius of a dome. It is further contemplated that ridge 122 may in some embodiments comprise a fillet 128 on a proximal side of the ridge 122, as shown in FIG. 1, in order to approximate the surface of the user's palm 200. It is contemplated that providing a fillet may eliminate sharp edges that could injure or otherwise be uncomfortable to the user when the cushion 120 is handled or pressed into contact with the hand. Indeed, it is even contemplated that design features other than a fillet may be utilized to approximate the surface of the user's palm 200 and eliminate potentially uncomfortable sharp edges.

Figure 3B:
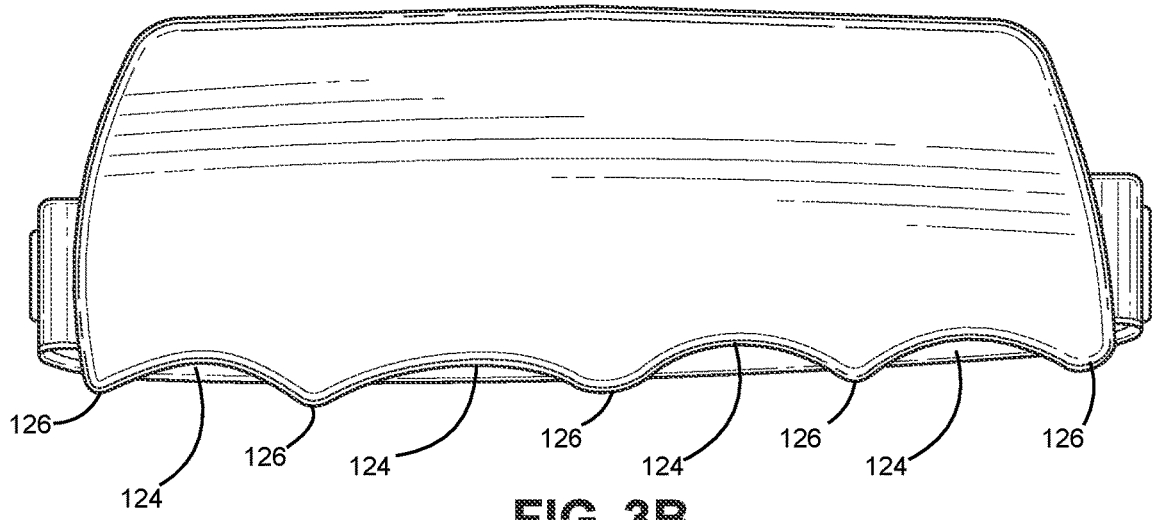
FIG. 3B shows a bottom view of a gripping apparatus in accordance with another embodiment of the invention.
Figure 4:
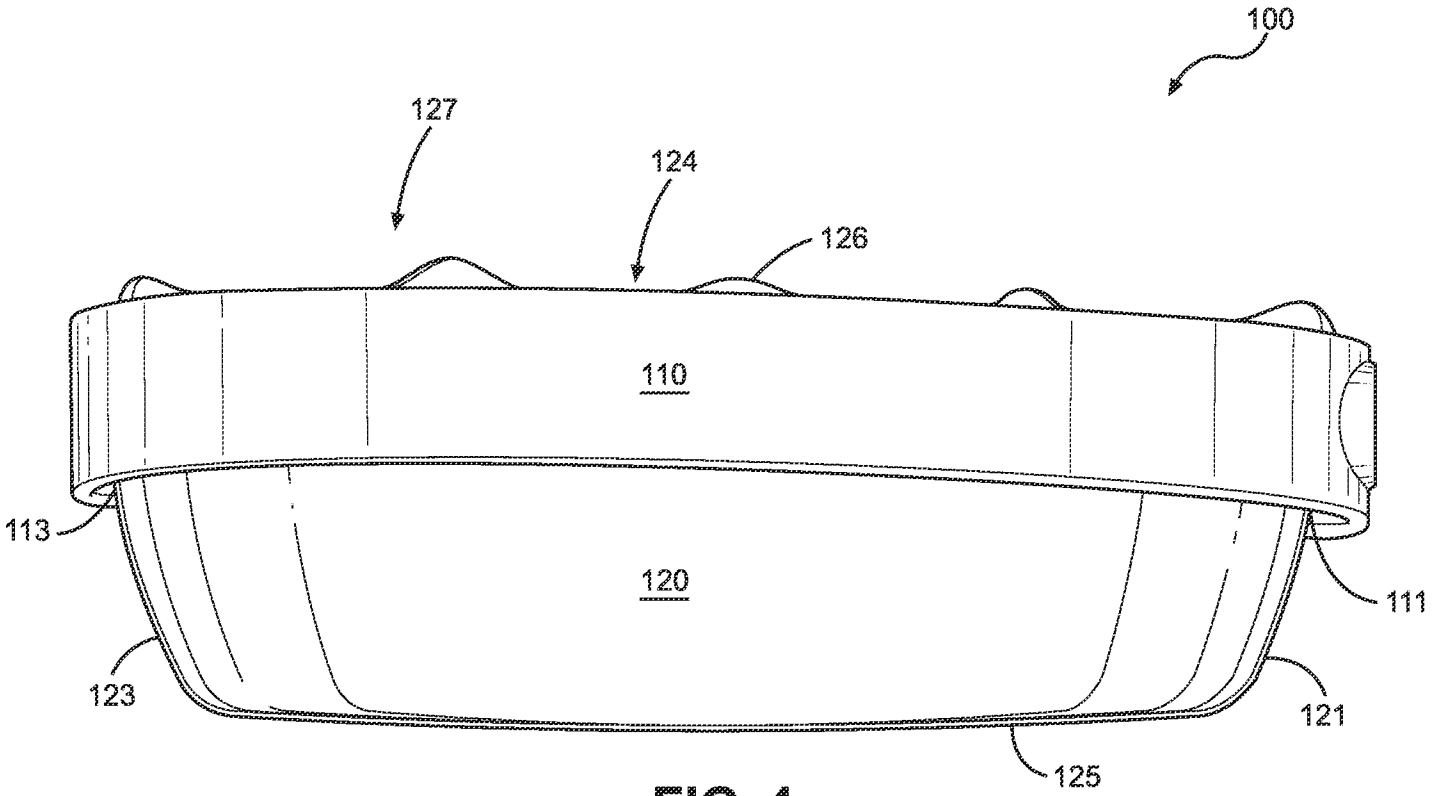
FIG. 4 shows a top view of a gripping apparatus in accordance with one embodiment of the invention.

With particular reference to FIG. 2, the front edge 127 of the cushion 120 may be defined by at least one groove 124. It is contemplated that the at least one groove 124 may comprise any number of grooves, such as one, two, three, or as in the non-limiting examples shown in the figures, four grooves. In some embodiments, as shown in FIG. 3B, any of the at least one groove 124 may comprise different dimensions from another of the at least one groove 124. It is further contemplated that the at least one groove 124 may be a rectangular groove, a T-slot, a dovetail groove, or as in the non-limiting examples shown in the figures, a radius groove. Each of the at least one groove 124 may be defined by at least one peak 126. The at least one peak 126 may be configured to align with a user's interdigital folds, or more colloquially, an outer side of the user's fingers, to create a barrier between the user's fingers.

As shown in FIG. 5, each of the at least one groove 124 may be sized in order to align with any of the user's fingers 204. Each of the at least one groove 124 may have a width defined by the distance between an adjacent two of the at least one peak 126.

In one embodiment, the at least one groove 124 may, for example, have a width in the range of about 0.25 to about 4.0 inches. The at least one groove 124 may further have a width in the range of about 0.5 to about 1.15 inches. In a further exemplary example, the at least one groove 124 may have a width in the range of about 0.75 to about 1.25 inches.

In an embodiment shown in FIG. 3B, any of the at least one groove 124 may be a different size than any of the other at least one groove 124. For example, a first groove may be operative to engage a user's pointer finger and thus sized accordingly. As such, the first groove may be sized such that it has a width in the range of about 0.68 to about 1.25 inches. In another embodiment, the first groove may have a width in the range of about 0.75 to about 1.13 inches. In a further exemplary embodiment, the first groove may have a width in the range of about 0.83 to about 1.2 inches.

A second groove may be operative to engage a user's middle finger and thus may be sized accordingly, for example, having a width selected from a range of about 0.6 to about 1.13 inches. The second groove may further have a width in the range of about 0.65 to 0.87 inches. Further exemplary widths for the second groove may be in the range of about 0.7 to about 1.0 inches.

A third groove may be operative to engage a user's ring finger and thus may be sized accordingly. For example, the third groove may have a width in a range of about 0.53 to about 1.0 inches. It is further contemplated that the third groove may have a width in a range of about 0.62 to about 0.75 inches. In some embodiments, the range may be from about 0.69 to about inches.

A fourth groove may be operative to engage a user's little finger and thus may be sized accordingly and thus may have a width in the range of about 0.43 to about 0.93 inches. It is further contemplated that the fourth groove may have a width in the range of about 0.5 to about inches. In some embodiments, the range may be from about 0.62 to about 0.81 inches.

Notwithstanding the foregoing, in some embodiments, the width of each groove may be selected to widen the user's grip relative to such user's natural resting or even unaugmented gripping position. That is, the width of each groove may be selected to gently separate the user's fingers from one another when in use. As such, it is contemplated that each groove may be relatively wider than each of a user's fingers, though this may not be necessary to practice the invention.

With particular reference to FIGS. 3A, any of the at least one groove 124 may be offset from another of the at least one groove 124. As such, any of the at least one peak 126 may have a height different from another of the at least one peak 126. It is contemplated that the offset may be offset to increase the fit of the band 100 to the user's hand 202. Thus, in some embodiments, the at least one groove 124 may be offset in order to approximate the natural curvature of a top edge of the user's palm. In yet a further embodiment, the band 100 may be specific to a left hand and thus the at least one groove 124 may be offset in order to approximate the natural curvature of a top edge of the user's left palm. Of course, in another embodiment the band 100 may be specific to a right hand and thus the at least one groove 124 may be offset in order to approximate the natural curvature of a top edge of the user's right palm. However, in yet another embodiment, the at least one groove 124 may approximate the natural curvature of both the top edge of the user's left and right palms, and thus the band 100 may be used on either the left or the right hand, as needed or desired.

With reference to FIG. 7, an embodiment of the band 100 is shown in use with one possible orientation. In particular, FIG. 7 demonstrates the band 100 in use as positioned on the user's hand 202 shown in FIG. 5. With continued reference to FIG. 5, the band 100 may be worn such that each of the at least one groove 124 aligns with the user's fingers 204 and the strap 110 rests over a dorsal side of the fingers 204. It is contemplated that the ridge 122 (obscured) may align the front edge 127 of the cushion 120 and the at least one groove 124 with the ridge of skin on the user's palm 200 proximal to the user's fingers 204. This portion of the user's palm may be recognized by those of ordinary skill in the art as the palmar digital crease. Aligning the ridge 122 in this manner may effectively anchor the user's hand 202 around an object, in turn providing additional support and reducing pressure on the user's joints. With continued reference to FIG. 7, the cushion 120 may form to the user's hand 202 such that it flexes to allow for gripping of the object 160. Further, the ridge 122 (obscured) may align with the ridge of skin on the user's palm 200 proximal to the user's fingers 204 and thus may prevent impingement when worn as shown in FIG. 7. Preventing impingement may, as a person of ordinary skill will appreciate, prevent formation of calluses and friction related injuries.

FIG. 6 illustrates the band 100 when worn across a user's palm 200 to protect the user's palm 200. Wearing the band 100 in this configuration may be particularly advantageous in instances where the user is performing a pushing motion during which parallel force will be returned and applied throughout the user's palm 200 by the object 160 being gripped, particularly in the area of the hand where the cushion 120 rests.

It is contemplated that the band 100 may be worn around the user's wrist (not illustrated) such that it is out of the way when not being used for gripping.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the gripping apparatus is discussed in use with exercise equipment, however it is contemplated that the gripping apparatus may be used with household tasks, such as gardening or opening jars. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the gripping apparatus with which that terminology is associated. In general, the terms used in the following claims should not be constructed to limit the gripping apparatus to the specific embodiments disclosed in the specification unless the above description section explicitly defines such terms. Accordingly, the actual scope encompasses not only the disclosed embodiments, but also all equivalent ways of practicing or implementing the disclosed system, method and apparatus. The above description of embodiments of the gripping apparatus is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the gripping apparatus.

What is claimed is:

1. A gripping apparatus, comprising:

a strap having a first end, a second end, an inner surface, and an outer surface;

a cushion having a front edge and a rear edge, the front edge defined by at least one groove, the front and rear edges separated from one another by a first and a second side edge, and the cushion further having an inside and an outside; and a ridge disposed along the inside of the cushion between the cushion front and rear edges and spanning the distance between the first and second side edges;

wherein the first side edge of the cushion is connected to the first end of the strap, and the second side edge of the cushion is connected to the second end of the strap to define a band.

2. The gripping apparatus of claim 1, wherein the at least one groove is configured to align with a proximal phalanx of at least one of a user's fingers.

3. The gripping apparatus of claim 1, wherein the front edge of the cushion is defined by four grooves corresponding to one each of a palm-side of a proximal phalanx of a user's four fingers.

4. The gripping apparatus of claim 1, wherein any of the at least one groove is offset from at least one other groove in imitation of the natural curvature of a top edge of a human palm.

5. The gripping apparatus of claim 1, wherein the at least one groove is defined by at least one peak operative to align with at least one of the user's interdigital folds.

6. The gripping apparatus of claim 5, wherein the at least one peak is further configured to separate the user's fingers from one another when in use.

7. The gripping apparatus of claim 1, wherein the ridge is configured to align with a user's palmar digital crease and define a barrier between any skin along a top edge of the user's palm and any skin along a base of the user's fingers when the user's first is curled.

8. The gripping apparatus of claim 1, wherein the ridge is configured to mold to the shape of any surface in contact with the inside of the cushion.

9. The gripping apparatus of claim 1, wherein the thickness of the cushion tapers as it extends proximally from the ridge to the rear edge.

10. The gripping apparatus of claim 1, wherein the gripping apparatus comprises an elastic material.

11. The gripping apparatus of claim 1, wherein the band is sized to receive a user's hand therethrough, the strap corresponding to a dorsal surface of the user's hand and the cushion corresponding to a palmar surface of the user's hand.

12. A gripping apparatus comprising:

a strap having a first end, a second end, an inner surface, and an outer surface;

a cushion having a front edge and a rear edge, the front edge defined by a first groove, a second groove, a third groove, a fourth groove, the front and rear edges separated from one another by a first and a second side edge, and the cushion further having an inside and an outside; and a fin-shaped ridge disposed along the inside of the cushion between the cushion front and rear edges and spanning the distance between the first and second side edges, the ridge having a height selected from a range from about 0.15 to about 0.31 inches at an angle operative to engage a user's palmar digital crease;

wherein each groove has a width selected from a range inclusive of 0.62 and 1.21 inches; and wherein the first edge of the cushion is connected to the first end of the strap, and the second side edge of the cushion is connected to the second end of the strap to define a band.

13. The gripping apparatus of claim 12, wherein the first groove has a width selected from a range inclusive of 0.75 and 1.21 inches;

wherein the second groove has a width selected from a range inclusive of 0.70 and 1.00 inches;

wherein the third groove has a width selected from a range inclusive of 0.69 and 0.86 inches; and wherein the fourth groove has a width selected from a range inclusive of 0.62 and 0.81 inches.

14. The gripping apparatus of claim 12, wherein the first, second, third, and fourth grooves are offset from one another in imitation of the natural curvature of a top edge of a user's palm.

* * * * *